United States Patent [19]

Cannon

[11] 4,084,802

[45] Apr. 18, 1978

[54] PICTURE FRAME VISE

[76] Inventor: Harold Lee Cannon, 314 W. University Dr., Chapel Hill, N.C. 27514

[21] Appl. No.: 813,630

[22] Filed: Jul. 7, 1977

[51] Int. Cl.[2] ..... B25B 1/20

[52] U.S. Cl. ..... 269/41

[58] Field of Search ..... 269/41, 42, 154, 271, 269/53, 54.1, 244, 240

[56] References Cited

U.S. PATENT DOCUMENTS

| | | | |
|---|---|---|---|
| 171,899 | 1/1876 | Williams | 269/42 |
| 949,096 | 2/1910 | Stetson | 269/53 |
| 1,068,686 | 7/1913 | McGill | 269/244 |
| 3,682,467 | 8/1972 | Heinrich | 269/41 |
| 3,704,879 | 12/1972 | Nishikawa | 269/240 |

*Primary Examiner*—Robert C. Watson
*Attorney, Agent, or Firm*—B. B. Olive

[57] ABSTRACT

A motor driven picture framing vise mounts a pair of finger tip control buttons on the vise table convenient to the operator for locking and releasing the vise. A post and support arrangement provides adjustable vertical positioning of the vise table and swinging of the table around horizontal and vertical axes suited to particular picture framing operations. Interchangeable wedges allow various frame angles, e.g., rectangular, hexagonal and octagonal, to be joined and railing adjustments enable a wide latitude in thickness of the framing being joined.

1 Claim, 5 Drawing Figures

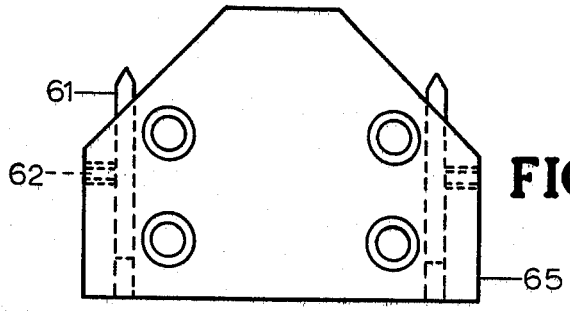
FIG. 3
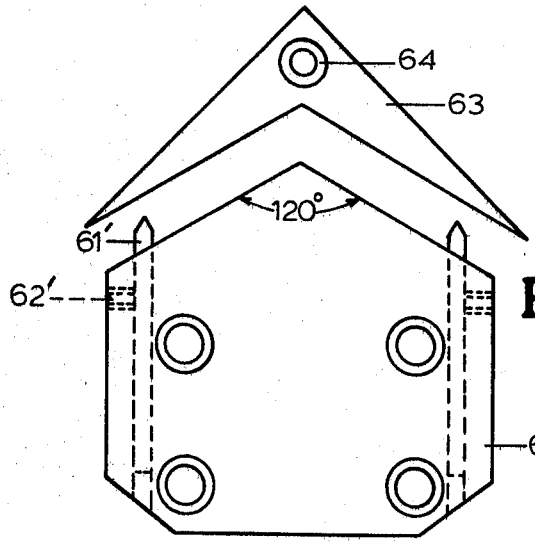
FIG. 4
FIG. 5
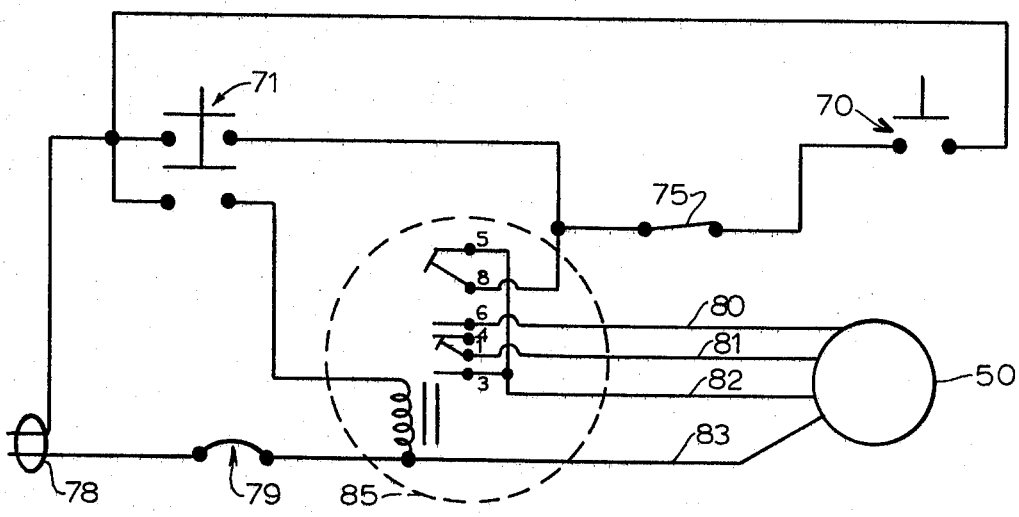

PICTURE FRAME VISE

BACKGROUND OF THE INVENTION

1. Field of the Invention

This invention generally relates to the picture framing vise or clamping apparatus and more specifically to a motorized picture framing vise.

2. Description of the Prior Art

Clamping apparatus for positioning and maintaining a pair of mitered end picture frame moldings have been found in a great variety of configurations. U.S. Pat. Nos. 3,682,467 and 3,944,200 are cited as examples of hand-operated clamping apparatus of this nature. All such picture frame clamping apparatus so far as is known has been basically hand-operated and no provision has been made for motorized operation.

More specifically, the prior art apparatus has lacked both a motorized drive for the vise and equally important a convenient switching configuration for operating the vise between clamping and release positions so as to make the operation less demanding of time and effort. Therefore, a principal object of the present invention is that of providing a motorized vise with an exceptionally convenient control configuration and a cushioned clamping effect. Another object is to provide such a motorized device having substantial versatility with respect to the number of sides of the frames as well as with respect to the size of the frames accepted by the apparatus. Also, an object is to achieve such a device in which the motor drive mechanism and its operation is designed so as not to interfere with the framing operation.

SUMMARY OF THE INVENTION

The apparatus of the invention generally comprises a slotted table, railings at one corner of the table and a motor driven vise which moves between clamp and release positions and is connected through the slotted table to a motor drive arrangement mounted below the table. A pair of finger tip control buttons are mounted on the same corner with one button being in control of forward clamping motion of the device and the other button being in control of rearward release motion of the vise. A variety of interchangeable wedge shapes enable various angled frames such as rectangular, hexagonal and octagonal sided frames to be joined and in a wide range of sizes.

DESCRIPTION OF THE DRAWINGS

FIG. 3 is a plan view of the wedge by itself as employed in FIG. 1.

FIG. 4 is an alternate wedge and wedge abutment configuration for hexagonal framing.

FIG. 5 is a wiring diagram for the electric drive system of the invention.

DESCRIPTION OF THE PREFERRED EMBODIMENT

Figure 1:
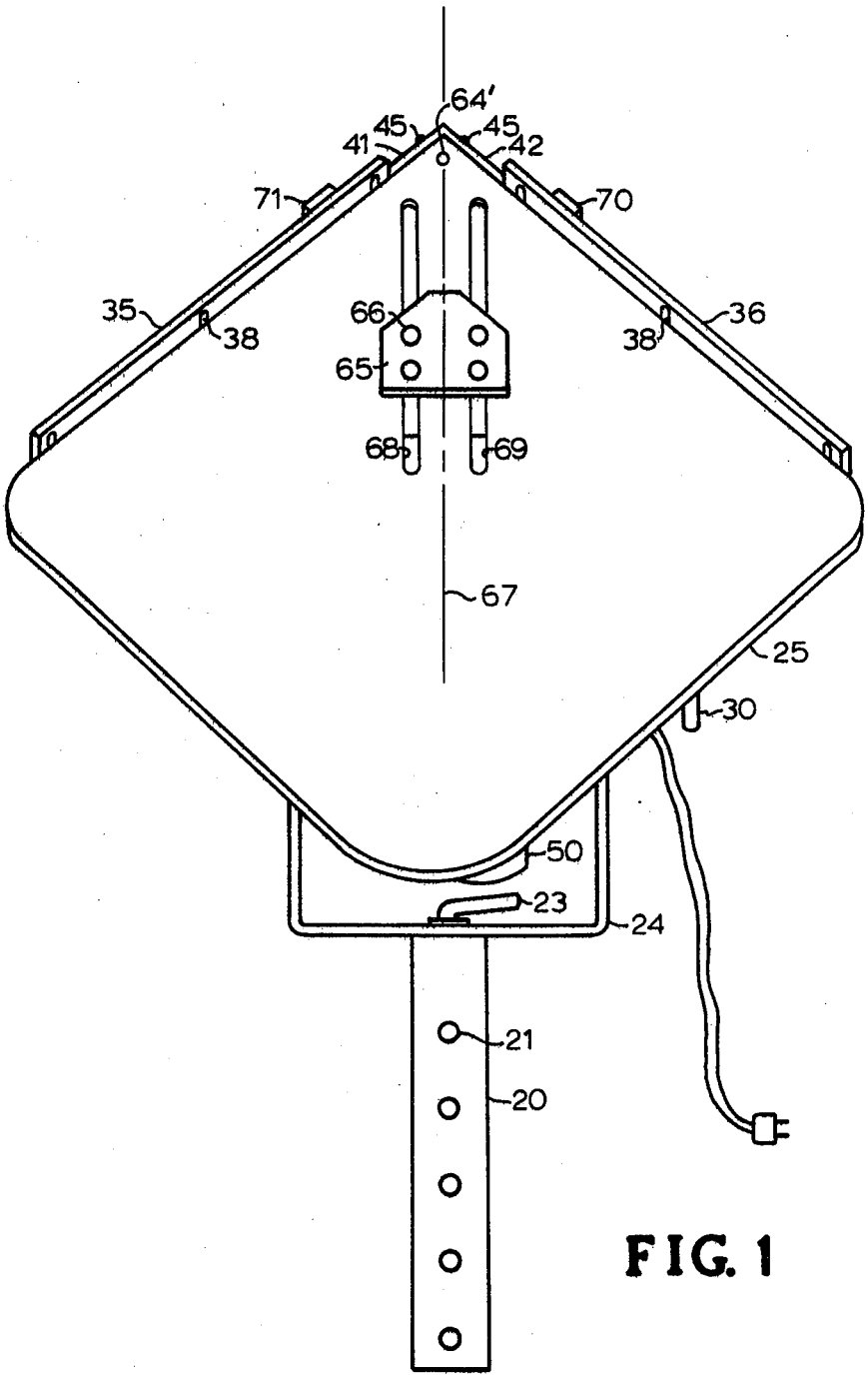
FIG. 1 is a frontal view of an unmounted picture framing vise according to the invention and shown with the vise table at an angled position.

The apparatus pictured in the drawings generally illustrates a picture framing vise having a motor operator with finger tip controls enabling the vise to be moved between clamping and release positions. The apparatus of the invention is intended to accommodate variously angled frame members such as for rectangular, hexagonal, octagonal side frames and molding thickness over a wide range, e.g., 6 inches to ¼ inch. Also, a cap molding as well as wing molding and wood liners are accommodated by the apparatus of the invention. With more specific reference to the drawings, the illustrated apparatus is intended to be bolted to a worktable by mounting the support post 20 to an appropriate worktable, or the like, by passing a suitable number of bolts, not shown, through holes 21 which allows the vise table 25 to be positioned at a convenient working height in the framer's work area.

A horizontal hand-locking bar 23 controls rotative positioning of a U-frame 24 around the vertical axis of post 20 on which U-frame 24 mounts. Frame 24 in turn mounts vise table 25 by means of brackets 27, 28. An additional hand-locking bar 30 is fitted on frame 24 and allows vise table 25 to swing around a horizontal axis X (FIG. 2) parallel to a table diagonal extending through the upper ends of U-frame 24 and between angled positions as in FIG. 1 or to a vertical position as in FIG. 2. It will be understood that locking bars 23 and 30 are fitted with appropriate screw and nut arrangements to facilitate such adjustments.

A pair of rails, indentifed as "high rails" 35, 36 are vertically slotted as at 38 and are vertically adjustable by loosening and tightening of Allen screws 40. The high rails 35, 36 have a perpendicular relationship and are intended to give backing support and surface abutments for cap molding but can be lowered to the lesser height of a second pair of rails, identified as "low rails" 41, 42, e.g., preferably down to a height of one quarter inch, to make frames from wing molding. Also, high rails 35, 36 can be lowered even further so as to reside even with the surface of the vise table 25 to accommodate wider angled framing such as hexagonal or octagonal in a manner later described. Low rails 41, 42 preferably provide fixed abutment surfaces one-quarter inch high and in effect provide the joining point. Low rails 41, 42, like high rails 35, 36 have a perpendicular relation to each other as shown. Low rails 41, 42 are secured by appropriate screws 45 and have suitable slots or openings for nailing, countersinking, doweling, or like fastening operations.

The vise drive includes a reversible drive motor 50 connected to a gearbox 51 which, in turn, drives a worm screw 52 through a "Love Joy" cushioned coupling 53 and a bearing mount 54. Such a coupling provides a useful cushioned clamping effect once the wedge is fully advanced. A screw block 60 threadably mounts on screw 52 on the underside of vise table 25 and travels on screw 52 in a direction controlled by the direction of motor 50. On the opposite front side of vise table 25 a vise wedge 65 is secured to gear block 60 by appropriate screw connections 66 which pass through and travel in a pair of slots 68, 69 residing parallel to and on either side of a line 67 bisecting the joining point. While a single slot might be employed, the illustrated dual slot arrangement is preferred. Thus, as drive motor 50 operates in one direction vise wedge 65 is caused to travel forwardly and towards the joining point over slots 68, 69 and when motor 50 operates in an opposite direction vise 65 is caused to travel rearwardly over slots 68, 69 and away from the joining point. Forward control of motor 50 and vise 65 is maintained by a right finger tip control button 70 and rearward or release control of wedge 65 is maintained by finger tip control button 71, both of which buttons are mounted proximate the joining point. A limit switch 75 resides in the rearward path movement of gear block 60 to limit rearward travel. A junction box 77 receives the line supply 78 and overload protection is provided by a thermal reset button switch 79 housed in junction box 77. Normally, the operator will be able to hear the motor hum when the vise is fully engaged. However, reset switch 79 allows the circuit to be quickly reset after a short time for the motor to cool in the event it is overloaded.

Figure 2:
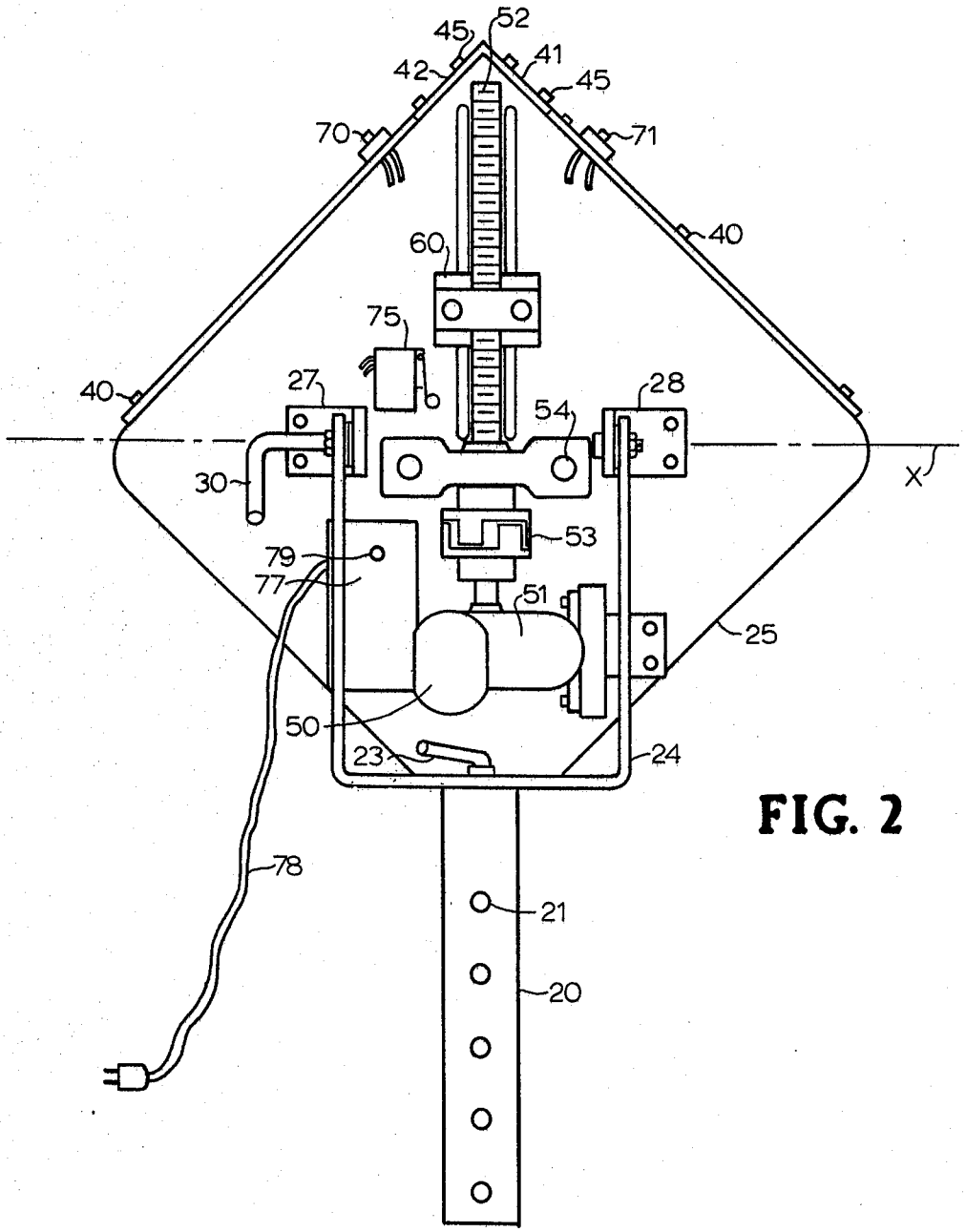
FIG. 2 is a rear view of the apparatus of FIG. 1 with the vise table in a vertical position for illustration and showing the vise drive mechanism.

In the mode of operation illustrated in FIG. 1, the apparatus is set up for joining rectangular, i.e., four-sided, frames. Important to the success of the invention is the employment of a plurality of points or spikes 61 on the leading edges of the wedge member 65 and which are designed to force the two pieces of molding closer together at the join. Outward extension of spikes 61 is controlled by appropriate set screws 62. As the spikes 61 bite into the wood under the rabbit for added grip, the wedge 65 locks the molding, vise-like, against the low rails 41, 42 which then frees both hands to drill, nail and countersink. In such operation, high rails 35, 36 may be suitably positioned for adding backing surface or to accommodate the particular type of molding.

Another aspect of the invention concerns the interchangeability of wedge member 65 with another wedge of different angle. The invention contemplates employment of the apparatus for various multi-sided frames such as rectangular, hexagonal and octagonal frames as previously mentioned. As one such example, FIG. 4 illustrates another wedge set such as might be employed for hexagonal framing where the frame members reside at a 120° angle with respect to each other. Octagonal or other multi-sided wedge sets would be modified accordingly. In FIG. 4, wedge 65' represents a wedge replacement suited for hexagonal framing and mating backing member 63 represents a mating abutment device intended to be secured to vise table 25 by insertion of appropriate screws in holes 64 of backing member 63 and into mating holes 64' provided in the upper surface of vise table 25. In use for joining a hexagonal frame, once replacement wedge member 65' and backing member 63 are installed, the high rails 35, 36 are lowered down so as to reside even with the top surface of vise table 25 and their corresponding tightening screws 40 are adjusted accordingly. Wedge member 65' includes an appropriate number of spikes 61' and set screws 62' as shown in FIG. 4 and which work in the manner previously described.

A circuit diagram suited to the invention is illustrated in FIG. 5. Motor 50 represents a reversible motor of suitable power and speed and through lines 80, 81, 82, 83 connects to a controlling double pole, double throw relay 85 which is arranged to prevent simultaneous operations of the control button switches 70 and 71. The relay diagram shown in FIG. 5 is that found on the Archer relay, Radio Shack catalog item 275–207 and will be understood accordingly. Forward switch 70 in FIG. 5 is a normally open, single pole, single throw push button switch and reverse switch 71 is a double pole, single throw, normally open push button switch. Power is provided through line 78 and limit switch 75 (also seen in FIG. 2) is placed in the circuit as shown in FIG. 5. Overload protection is provided by thermal reset switch 79.

In summary, it can be seen that there has been provided an exceptionally convenient motorized picture framing vise adapted to a wide range of frame thicknesses and multi-sided frames.

I claim:

1. A mitered corner joining clamp device for simultaneously applying pressure to a pair of mitered picture frame members, comprising:

(a) a vise worktable having secured thereto at a selected joining point corner backing means provided adjustable upstanding wall surfaces positioned at a predetermined included angle therebetween, said vise worktable further including an elongated slot configuration oriented parallel to a line bisecting said angle;

(b) an adjustable wedge member slidably positioned on the outer side of said vise worktable for travel along said slot configuration and having leading edge surfaces for applying a corner pressure against a pair of mitered picture frame members interposed against said surfaces, said wedge member including adjustable pointed means on the leading edge surfaces thereof adapted to engage said picture frame members;

(c) reversible drive means mounted on the underside of said vise worktable and including a reversible electric drive motor, a screw member driven thereby and a screw block traveling thereon secured through said slot configuration to said wedge member;

(d) respective forward and reverse control means mounted on said vise worktable for energizing said drive motor selectively in forward and reverse modes of operation thereby enabling said screw block to cause said wedge member to be selectively driven toward said surfaces for clamping said pair of mitered picture frame members or away from said surfaces to release said pair of mitered picture frame members after being joined, said control means including a pair of finger tip electric control buttons and circuit means associated therewith, one of said finger tip control buttons being mounted on one side of said vise worktable proximate said joining point corner at which said pair of mitered picture frame members are intended to be joined and the other switch member being mounted at an opposite position of said vise worktable with both of said switch members being accessible for finger tip button control;

(e) additional switch means mounted on the underside of said vise worktable and arranged to be engaged by said screw block during rearward travel thereof to deenergize said drive motor and thereby limit the rearward motion of said gear block member and cushioned coupling means coupling said screw member to said drive member adapting said wedge to provide a cushioned clamping effect; and (f) post and bracket support means secured to the underside of said vise worktable, said post and bracket support means including a bracket pivotably secured to said underside and mounting first clamp means for adjustably positioning said vise worktable around a horizontal axis beneath said vise worktable and perpendicular to the line bisecting said angle, said post and bracket support means further including a vertical post pivotally mounting said bracket and mounting second clamp means for adjustably positioning said vise worktable about a vertical axis extending through said post means and perpendicular to said horizontal axis.

* * * * *